United States Patent [19]

Rebajes

[11] 4,214,747

[45] Jul. 29, 1980

[54] MOBILE GEOMETRICAL FORM

[76] Inventor: Francis Rebajes, San Miguel, 45, Torremolinos-Malaga, Spain

[21] Appl. No.: 894,604

[22] Filed: Apr. 7, 1978

[51] Int. Cl.[2] ..... D04D 9/04

[52] U.S. Cl. ..... 272/8 R; 35/73; 156/195; 428/7; 428/542; 29/446

[58] Field of Search ..... 272/8 R, 8 D, 8 N; 35/73; 428/542, 7, 37, 9; 46/1 L, 57; 156/195; 40/124.1; 116/168; 267/92, 168, 86

[56] References Cited

U.S. PATENT DOCUMENTS

| | | | |
|---|---|---|---|
| 1,389,168 | 8/1921 | Sturm | 267/92 X |
| 3,511,280 | 5/1970 | Mercier | 267/168 X |
| 3,880,414 | 4/1975 | Smith et al. | 267/168 |
| 3,884,462 | 5/1975 | Rebajes | 272/8 R |
| 3,933,345 | 1/1976 | Fidi et al. | 267/168 |

FOREIGN PATENT DOCUMENTS

| | | | |
|---|---|---|---|
| 1519595 | 2/1968 | France | 267/168 |
| 2311225 | 12/1976 | France | 267/168 |
| 780282 | 7/1957 | United Kingdom | 267/87 |
| 827400 | 2/1960 | United Kingdom | 428/9 |

*Primary Examiner*—Richard C. Pinkham
*Assistant Examiner*—Arnold W. Kramer
*Attorney, Agent, or Firm*—Friedman, Goodman & Teitelbaum

[57] ABSTRACT

A mobile geometrical form having two helical sections interdigitally wound into each other about a common axis. The helical sections are of substantially the same radius and are out of phase with respect to each other. Each end of one helical section continues into a twisted loop, which in turn continues into the adjacent end of the other helical section to thereby form a unitary structure. The geometrical form is comprised of a double sided continuous strip of material. Optionally, a tube axially extends through the helical sections and serves to anchor the loops at either end in spaced apart relationship, while permitting translatory motion of the unitary structure therethrough.

20 Claims, 15 Drawing Figures

MOBILE GEOMETRICAL FORM

BACKGROUND OF THE INVENTION

This invention relates to a geometrical form and more particularly to a geometrical form which can assume an infinite number of relative positions while maintaining the shape of the geometrical form.

Geometrical forms are utilized in various areas including structural design, art, industrial machinery, display and decoration. Most of the geometrical forms are utilized in a fixed position. However, others move in order to achieve their purpose.

One unique type of mobile geometrical form is described in U.S. Pat. No. 3,884,462, issued to the inventor of the present invention. In that patent, a unique mobile geometrical form is described which is in the general shape of a hyperbolic paraboloid having a double sided continuous strip of material with each side having four points of inflection to result in four surface portions having successive concave and convex contours.

The unique mobile geometrical form of the aforementioned patent provides varied uses. For example, it can be utilized for ornamental as well as mechanical purposes, and can also provide exercise and amusement.

While the aforementioned mobile geometrical form serves many purposes, its particular structure is limited in size and shape to include only the four points of inflection and effectively provides a modified four sided structure. There is no availability of expanding the structure into an enlarged form or to extend it and amplify it into a developed structure. Additionally, the amount of translatory motion of the strip is fixed, and the amount of force required to translate motion of the strip is limited by the restricted shape of its geometrical form.

SUMMARY OF THE INVENTION

Accordingly, it is an object of the present invention to provide a novel geometrical form which provides improved properties not heretofore shown in prior art geometrical forms.

It is another object of the present invention to provide a novel geometrical form which avoids the aforementioned problems of prior art devices.

Still another object of the present invention is to provide a novel geometrical form which can be expanded and amplified to a desired developed condition.

Another object of the present invention is to provide a mobile geometrical form which can be of any size desired, in accordance with the particular use to which it is intended.

It is another object of the present invention to provide a mobile geometrical form which provides continuous translatory motion of the form itself while maintaining its geometrical shape. It is a further object of the present invention to provide a mobile geometrical form which can translate linear into curvelinear motion and vice versa.

It is yet a further object of the present invention to provide a mobile geometrical form which is in the general shape of an interdigitally wound series of helixes continuously interconnected to form a unitary structure.

Briefly, the present invention provides for a mobile geometrical form having first and second axially extending helixes which are interdigitally wound into each other. The ends of one of the helixes continues into a twisted loop which in turn continues into the adjacent end of the other helix. A similar twisted loop interconnects adjacent ends at the opposite end of the helixes. In this manner, a single unitary structure is achieved.

The helixes are of substantially the same radius and are out of phase with each other. The geometrical form is formed of a double sided continuous strip of material, so that a first side of one helix continues into a second, opposite side, of the other helix.

The geometrical form is made of semi-rigid flexible material whereby the strip can assume the geometrical form in an infinite number of relative positions of the strip. The stresses established in the strip redistribute themselves in each relative position of the strip to maintain the shape of the geometrical form. An axially extending tube can be placed through the helixes. The twisted loops can be anchored on the tube to retain the loops in axially spaced apart relationship. At the same time, translatory movement of the unitary structure through the tube is facilitated.

The present invention also contemplates a method of forming such a mobile geometrical shape starting from a spiral formed of a semi-rigid flexible strip material. A first end of the spiral is bent toward the rest of the spiral and is then rotated along the spiral in the same direction as the spiral itself. The opposite end is also bent toward the rest of the spiral and is likewise rotated along the same direction as the spiral. The two ends are then brought together and are joined to make a single continuous unitary structure. The initial spiral can be formed of interconnected slotted annular strips of substantially identical construction.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
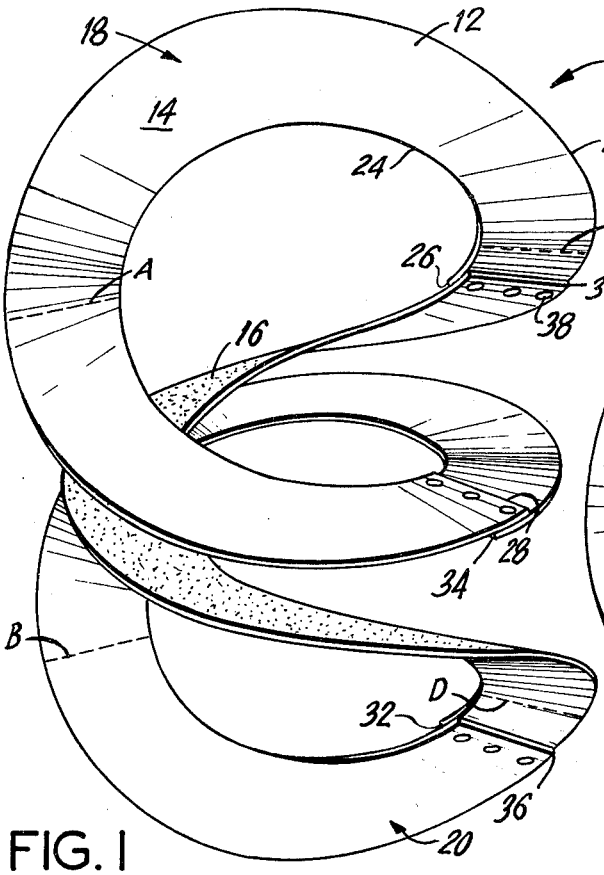
FIG. 1 is a perspective view of one embodiment of the mobile geometrical form in its simplest structure.

Referring now to FIG. 1 there is shown at 10 one form of the mobile geometrical form of the present invention which is formed of strip material 12 having a first surface 14, shown as the upper surface and is shown as being clear, and a second surface 16 on the underside thereof and is shown as being stippled.

The geometrical form includes a first helical portion roughly commencing from line A and continuing in a counterclockwise direction to roughly line B. It will be noted that this helical section includes only a single complete turn. The helical section has the surface 14 facing in an upward direction. A second helical section, roughly starting at line C, also continues in a counterclockwise direction and terminates roughly along line D. The second helical section also includes a single turn. The second helical section has the stippled surface 16 facing in an upward direction, as viewed in FIG. 1.

Interconnecting the top edges from approximately the line A of the first helical section to line C at the top of the second helical section, is a twisted loop 18. Similarly, at the bottom, interconnecting the end line B of the first helical section with the line D of the second helical section is a second twisted loop 20. Both twisted loops extend substantially axially with respect to the helixes and is continuous with the helical portions to thereby form a single unitary structure.

It should be noted that the first side 14, shown as the clear side, from the first helix continues from line A around the upper twisted loop 18 to become the bottom side of the second helical section, commencing at line C.

Similarly, the underside, which would be the stippled surface, at the edge A of the first helical section continues around the backside of the upper loop 18 in order to become the top side of the second helical section, commencing at line C. It should also be noted, that the two helical sections are out of phase with each other by approximately 180°. Thus, the lines marked A and C are approximately diametrically opposed to each other and similarly the lines B and D would be diametrically opposed to each other.

The geometrical form is comprised of a double sided continuous strip of material which forms an external edge 22 around the entire structure and an internal edge 24 through the entire structure. The internal edge 24, at least between the helical sections, forms an opening centrally of the unitary structure.

Figure 3:
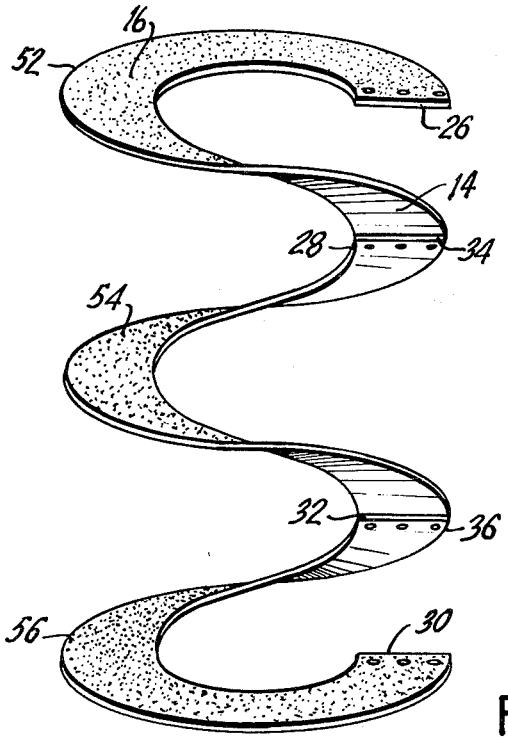
FIG. 3 is an isometric view of the helical coil utilized to form the mobile geometrical form shown in FIG. 1.

In order to facilitate manufacture of the unitary structure, rather than be of a single piece of material, the geometrical form is shown formed of sections. Specifically, a first section commences at edge 26 and continues around the upper loop 18 until the edge 28. A second section commences at the edge 30 and continues into the second helical section and terminates at the edge 32. The third section has one edge 34, continues as part of the first helical section, and then continues into a portion of the bottom loop 20 to its other edge 36. It should further be noted that the edges overlap and are interconnected by fastening means 38, such as rivets, screws, etc. While three such sections are shown, it is understood that the entire structure could be made of a single piece. The reason that three sections are utilized is that each section could be made of substantially identical size. Furthermore, each such section would then be a single annular disc having a slit through one side thereof. In this manner, the geometrical form can be developed by utilizing a plurality of identical annular sections each formed of substantially disc shape and having a slit through one side thereof. The discs are then interconnected with the end of one connected to the beginning of the next in order to form a spiral structure as shown in FIG. 3, and as will hereinafter be described. Thus, as many sections as desired can be interconnected in order to extend the geometrical form to any length desired, as will hereinafter be explained and as will be shown with regard to a further embodiment shown in FIGS. 7 and 8.

Figure 2:
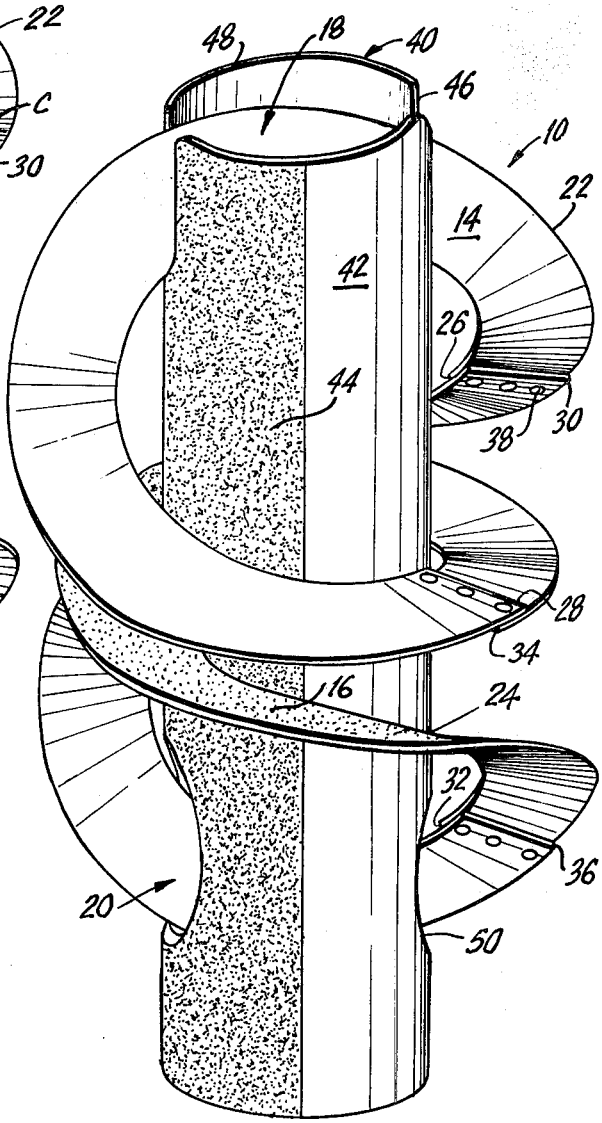
FIG. 2 shows the embodiment of the mobile geometrical form shown in FIG. 1 with the inclusion of an anchoring tube passing through the geometrical form.

Referring now to FIG. 2, there is shown the same unitary structure 10 as was shown in FIG. 1 with the inclusion of a tubular member 40 axially inserted within the two helical sections into the central opening defined by the internal edge 24 of the helical sections. For decorative purposes, the tubular structure is shown with first and second surfaces diametrically separated, with a first surface 42 shown as clear to match the surface 14 on one side of the geometrical form, and a stippled surface 44 shown on the other side to match the stippled surface 16 shown on the other side of the geometrical form.

The tube is shown as a cylinder by way of example and includes anchoring means to retain the upper twisted loop 18 and the lower twisted loop 20 in axially spaced apart position, while permitting translatory motion of the geometrical form therethrough. On the upper section the anchoring means is shown as a transverse channel 46 extending from the upper edge 48 of the tube and lying across a diametric plane of the tube. At the lower end, the anchoring means includes a transverse bore 50 passing along the same diametric plane through opposite sides of the tube. It will be understood that both sides could utilize the transverse channels or the transverse bores. As will be explained hereinafter, the use of the tube facilitates the translatory motion of the mobile geometrical form.

In forming the mobile geometrical form shown in FIG. 1, there is initially required a spiral of desired length. As shown in FIG. 3, a spiral is provided having three turns. While the spiral could be formed of a single continuous material, as heretofore explained, it is formed of three sections with each section being a disc of uniform width provided with a slit. Thus, the upper disc 52 would have adjacent slitted edges 26 and 28, the second disc 54 would have adjacent edges 34 and 36, and the third disc 56 would have adjacent edges 32 and 30. Edges of the disc are interconnected so that a second surface 16, shown as the stippled surface, is continuous through the three discs while the first surface 14 is also continuous through the three discs, and a spiral arrangement is formed. Three sections are shown in FIG. 3 which are needed to provide the structure shown in FIG. 1. However, additional sections could be added, as desired, in order to form a longer geometric form, as will be described hereinafter in connection with FIGS. 7 and 8.

Figure 4:
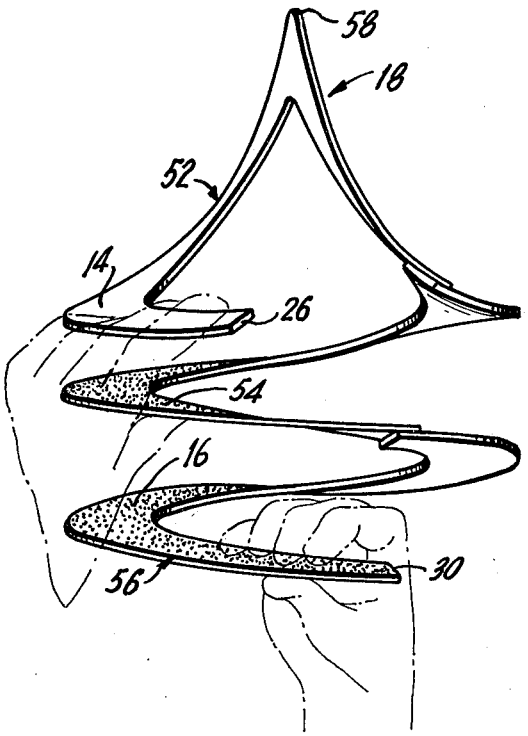
FIG. 4 is a perspective view showing the manner in which the spiral strip of FIG. 3 is modified in a first step in obtaining the structure shown in FIG. 1.

Once the spiral of FIG. 3 has been formed, the next step in developing the mobile geometrical form is to take one edge, shown as the edge 26 to bend it downwardly towards the rest of the spiral, and then continue rotating the edge 26 along the spiral in the same direction as the spiral itself. As shown in the drawing, the spiral rotates in a counterclockwise direction as viewed from the top. Therefore, the edge 26 will first be bent downwardly and then be moved along the section or disc 54 in a counterclockwise direction, as viewed from the top, to the position as shown in FIG. 4. It will be noted that the twisted upper loop 18 has thereby been formed, including a point of inflection 58 at the axially uppermost position.

Figure 5:
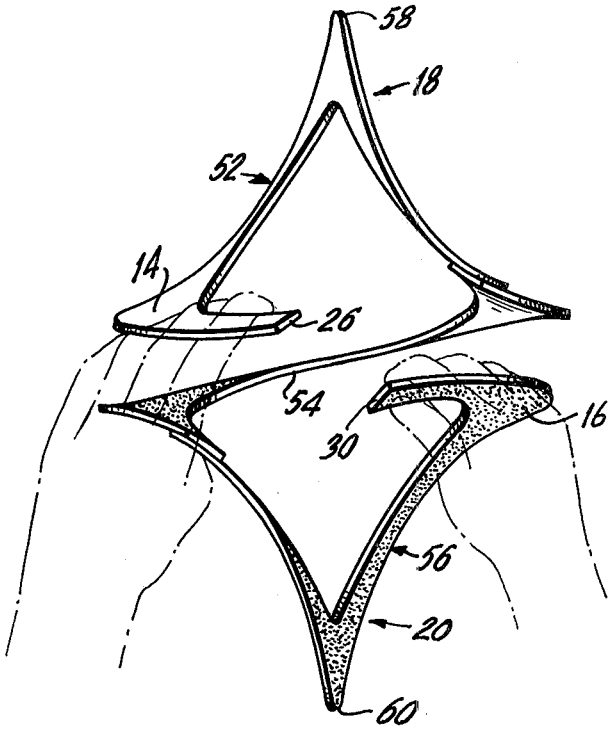
FIG. 5 is a perspective view showing a second step modification of the spiral of FIG. 3 in obtaining the structure shown in FIG. 1.

The next step is to similarly bend and rotate the bottom edge. As shown in FIG. 5, the edge 30 has been bent upward towards the spiral and moved in a clockwise direction, (as seen from the top) along the spiral section or disc 54. This forms the lower twisted loop 20 and includes a lowermost point of inflection 60 at the bottom most axial position.

Figure 6:
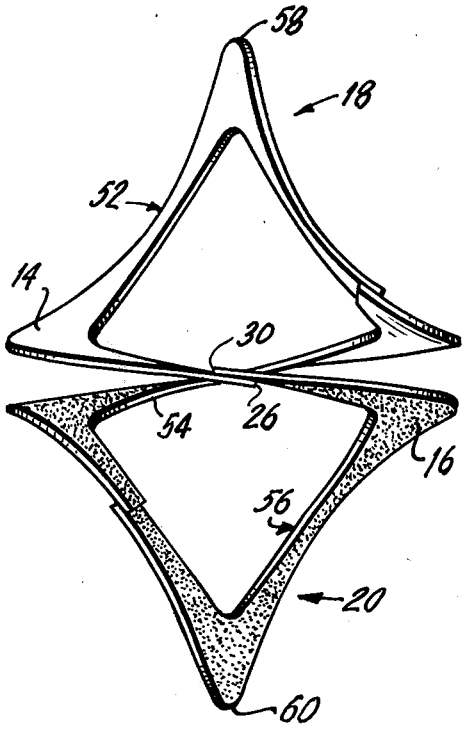
FIG. 6 shows the third and final step in the modification of the spiral of FIG. 3 and which is the same structure as shown in FIG. 1, slightly rotated in order to achieve a different perspective view thereof.

The final step is shown in FIG. 6, where the edges 26 and 30 are brought together such that the same surfaces are continuous. Thus, the upper clear surface of section or disc 52 continues onto the clear surface of the section or disc 56. Similarly, the stippled surface 16 on the underneath side of the section or disc 56 is connected so that it continues to the underneath stippled surface of section or disc 52. In this manner, a continuous unitary structure is formed. The unitary structure is again noted to have the two helical sections which are out of phase with each other and which are interdigitally wound into each other. The adjacent ends near the top are continuous into the upper twisted loop 18 and are continuous into the lower twisted loop 20, to form the unitary structure. It should also be noted that the structure shown in FIG. 6 is identical to the structure shown in FIG. 1 but is taken at a different perspective angle from that in FIG. 1. However, it comprises the same geometrical form.

Figure 7:
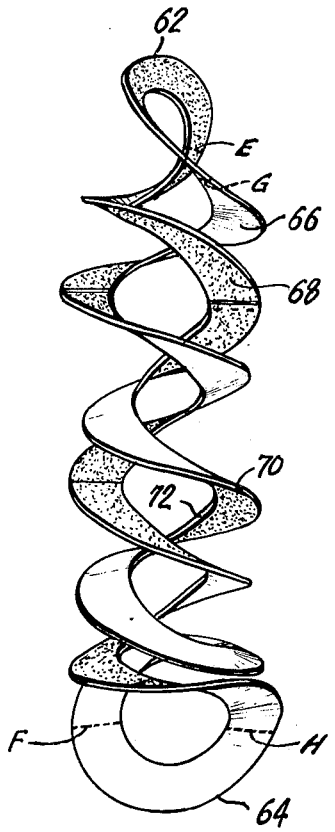
FIG. 7 shows another embodiment of the mobile geometrical form of the present invention, and including the development of an expanded version of the form of FIG. 1.

As heretofore noted, additional sections of the spiral could be added to thereby make a longer geometrical form. This could be achieved by adding additional annular discs to each other, edge to edge, in order to make additional rotational sections of the spiral. Alternately, if made of a single strip, additional turns could be included. As shown in FIG. 7, there is a longer form of the same type of mobile geometrical form, wherein additional turns of the helical sections are included. With reference now to FIG. 7, there is shown a first helical section beginning at approximately the line E and continuing through about three complete turns to reach the line F. A second helical section commences at approximately the line G and also continues through approximately three complete turns to terminate at approximately the line H. The upper adjacent lines E and G of the two helical sections are interconnected by means of a twisted loop 62, and similarly, the lower adjacent lines F and H are interconnected by means of the twisted lower loop 64. The twisted loops extend in substantially axial directions. The entire form is formed of double sided continuous strip material with a first side shown as being clear and noted as side 66, and a second side shown stippled and noted as side 68. Side 66 which appears as the underside of one helix adjacent the line G continues around the upper twisted loop 62 to form the upper side of the next helix at line E. Similarly, the stippled side 68 which is the upper surface at the line H continues around the lower loop 64 to form the underside at the commencement of the next helical section at line F. The two helixes are out of phase with each other by about 180° and are interdigitally wound into each other. The upper and lower loops 62, 64 form a continuous interconnection to the helical sections to thereby provide a unitary structure to the entire geometrical form.

Figure 8:
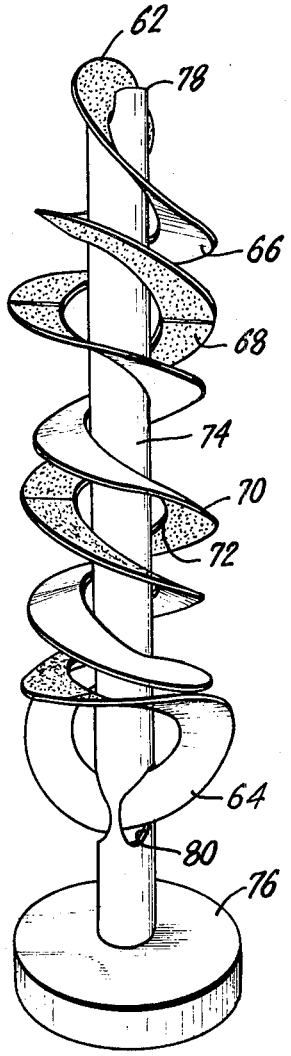
FIG. 8 shows the structure of FIG. 7 with the inclusion of an anchoring tube passing therethrough.

The continuous strip of material defines an external edge 70 and an internal edge 72. The internal edge, at least within the helical sections, defines an opening centrally of the form. As shown in FIG. 8, a tube 74 can be placed axially within the helical sections and specifically through the central opening defined by the inner edge 72. The tube includes a base section 76 for supporting the structure. Anchoring means are included on the tube for axially spacing the upper twisted loop 62 and the lower twisted loop 64 with respect to each other, while permitting translatory motion therethrough. At the upper end, the anchoring means includes a transverse channel 78 across the tube while at the lower end it includes a transverse bore 80 through the tube.

Figure 9:
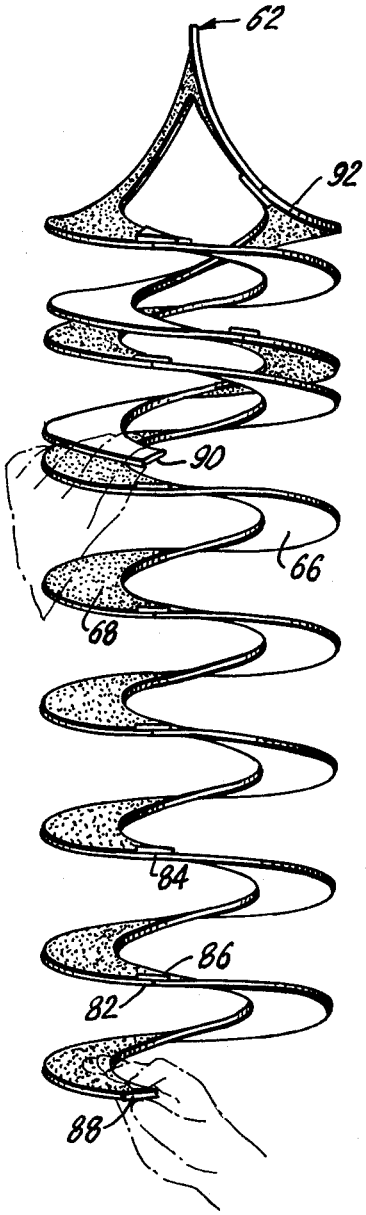
FIG. 9 is an isometric view showing an early development in the formation of the structure shown in FIG. 7.
Figure 10:
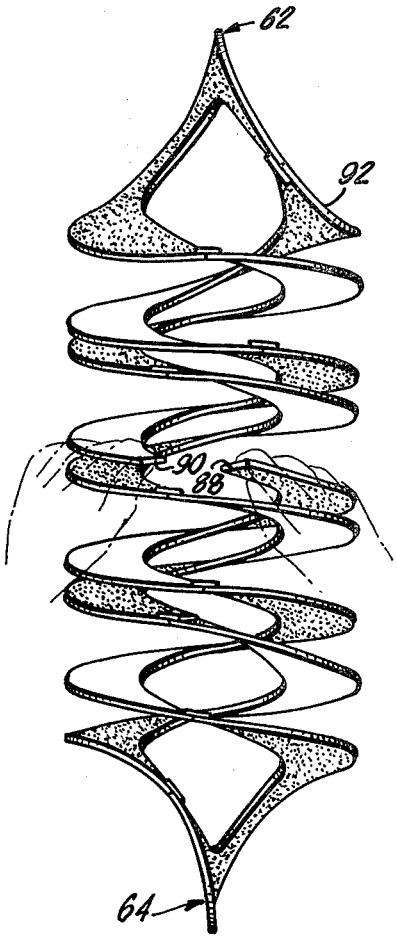
FIG. 10 shows a later step in the formation of the structure shown in FIG. 7.
Figure 11:
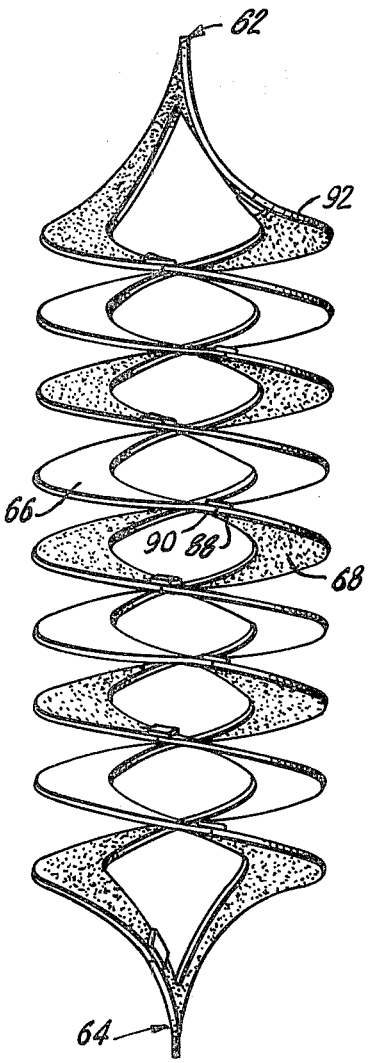
FIG. 11 shows the completed structure after development from FIG. 10, and is the same structure shown in FIG. 7 in a different perspective position.

Referring to FIGS. 9–11, the method of forming the structure shown in FIG. 7 will now be described. Initially, there is provided a spiral formed of 10 individual annular discs having the edge of one disc connected to the edge of the next disc in such a manner that all of the clear surfaces 66 are interconnected and all of the stippled surfaces 68 are also interconnected. One such section is shown as starting from edge 82 and continuing until edge 84. The sections are shown interconnected by means of a brace 86, however, the sections could also be interconnected by overlapping adjacent edges. The number of annular disc sections utilized to form the continuous spiral is a matter of choice, and more or less sections could be utilized as desired to determine the length wanted. Additionally, the spiral could be formed of one continuous piece rather than individual sections, although the formation by means of the sections provides an easier means of manufacturing since individual annular discs can be formed of equal size and shape.

When the spiral is formed, it contains one continuous length. There is a lower edge 88, and an upper edge 90. The upper edge 90 is downwardly bent toward the rest of the spiral and is then rotated along the spiral surface in the direction of the spiral itself. This is shown in FIG. 9 where the edge 90 has been wound in the direction of the spiral along two turns of the spiral. As it is continuously wound in the counterclockwise direction (as seen from the top) one upper loop 62 will always remain. However, additional material will be moved into this loop. For example, as the edge 90 would be moved downwardly, the next adjacent section shown at 92 would move upwardly to become the upper loop.

The next step is to bend the lower edge 88 upwardly toward the spiral, and to move that edge along the spiral surface in the same direction as the spiral itself. This is shown in FIG. 10 where the bottom edge 88 has been moved upwardly along the spiral surface in a clockwise direction (as viewed from the top). In so doing, one bottom loop 64 is formed and continuously remains with new material being moved into that bottom loop as the edge 88 is wound into the existing spiral.

The two ends 88, 90 are continuously wound into the existing spiral until their edges are brought together. These edges are then fastened together in such a manner that the clear surfaces 66 continue from one edge to the other, and at the same time the stippled surfaces 68 also continue from one surface to the next adjacent across the edges. In this way a continuous unitary structure is formed as shown in FIG. 11. It should be appreciated, that the structure shown in FIG. 11 is identical to the structure shown in FIG. 7 except that the perspective is taken at a slightly different angle. It should also be appreciated that by holding the opposing loops 62, 64, the entire mobile geometrical form can be axially twisted a slight degree displacing the interdigitally wound helixes with respect to each other. This would give the slightly non-symmetric appearance which is noted in FIG. 7, while maintaining the upper and lower loops to retain the shape, shown in FIG. 11.

Figure 12:
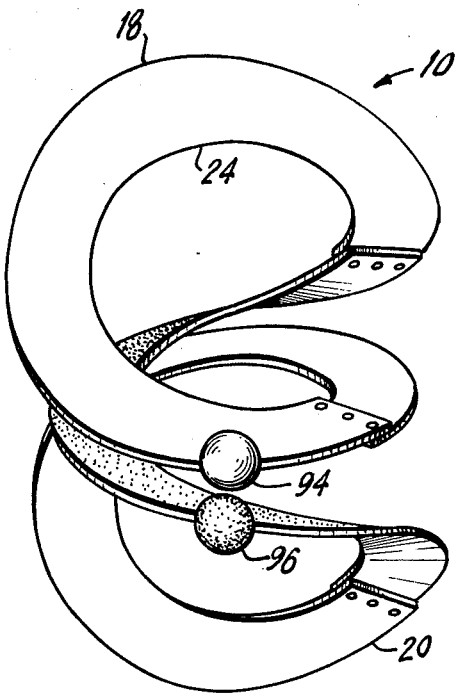
FIG. 12 is the same structure as shown in FIG. 1 including marking balls, and is redrawn for the purposes of showing the translatory nature of the mobile geometrical form.

The mobility or ability of the geometrical form to move or translate along itself is based on the semi-rigid characteristic of the resulting strip, the central opening defined by the internal edge and the ability of the resulting shape to reach a stable equilibrium and distribution of stresses which tend to maintain the strip in the desired shape or form. Referring now to FIGS. 12–15, the translatory movement of the form will be described. In FIG. 12 the form 10 as was described in FIG. 1 is again described, but now includes spherical marking ball 94 shown as being clear, and 96 shown as being stippled. The marking balls 94 and 96 are provided on the strip to indicate fixed points on the strip to thereby illustrate the translatory movement of which the form 10 is capable of achieving. In order to maintain the form, the cylindrical tube 40 is also utilized, as shown in FIG. 2, with the form placed in the central opening defined by the internal edge 24. The upper loop 18 passes through the upper channel 46 and the lower loop passes through the transverse bore 80.

Figure 13:
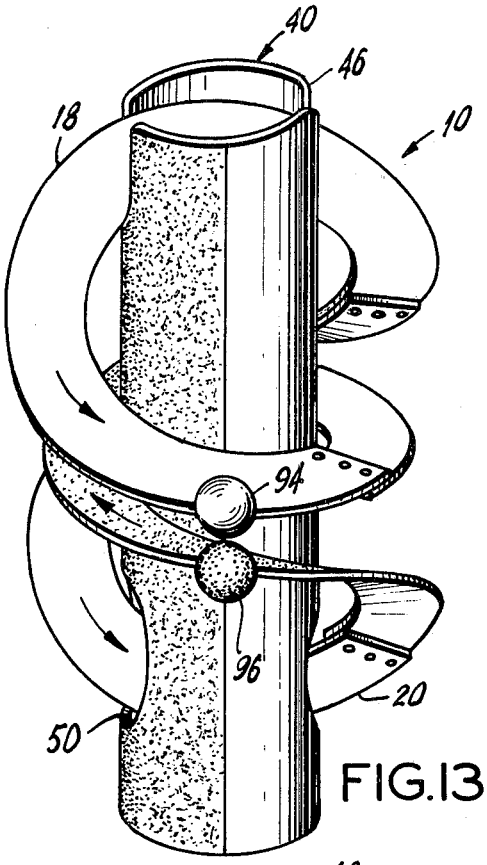
FIGS. 13–15 are isometric views of the structure shown in FIG. 12 and showing the manner in which the present invention permits translation or movement of the strip along a path generally defined by the form itself, whereby the strip may assume an infinite number of relative positions with the stresses establishing themselves in the strip redistributing themselves in each relative position to maintain the shape of the geometrical form.

To best understand the translatory movement, it is best to focus on the balls 94 and 96 and follow them through various positions as the form moves. It will be noticed that these balls will continuously move along a path generally defined by the form itself. Thus, the ball 94 is shown in FIG. 13 as being along one of the center portions of one of the helixes. If this helix would be rotated in a counterclockwise direction (as viewed from the top) the ball 94 would pass around the back of the tube and proceed downwardly as shown in FIG. 14, along the lower bottom loop portion 20.

Figure 14:
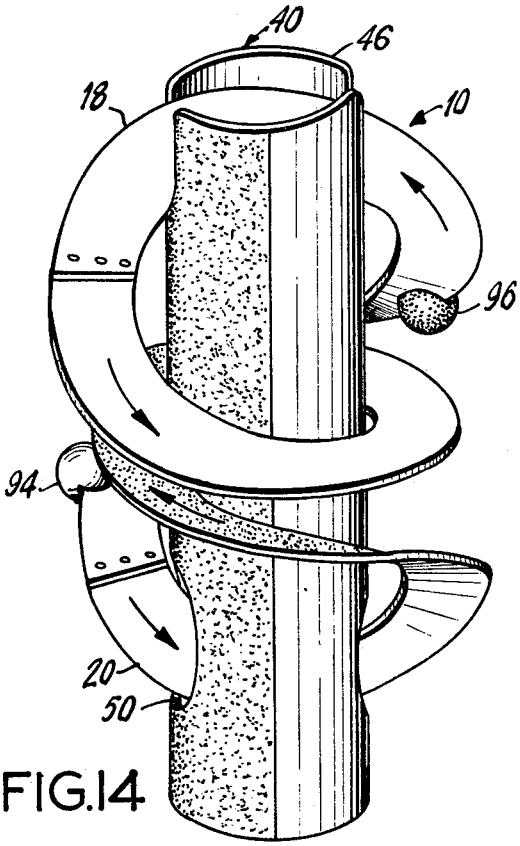
Figure 15:
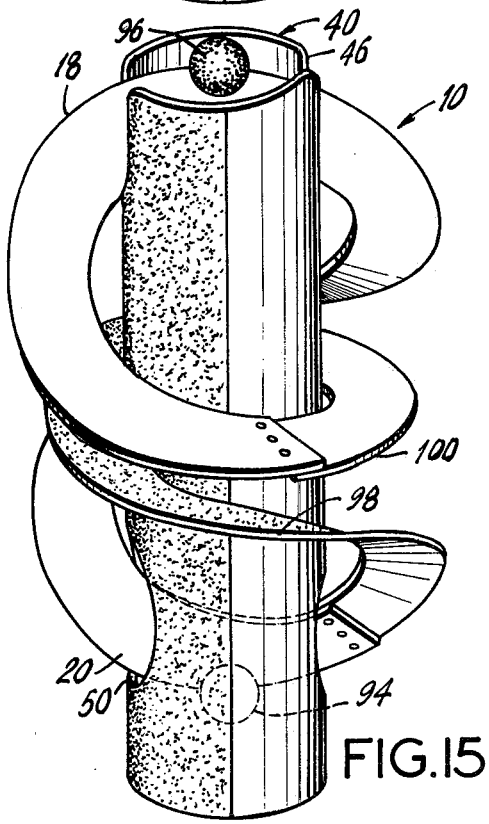

At the same time, the stippled ball 96 would have moved from its position in FIG. 13, around the back of the tube in an upward direction and be in the position shown in FIG. 14 as ready to enter into the upper loop section 18. As movement would be continued in the counterclockwise direction the stippled ball 96 would finally move to the topmost point of inflection of the upper loop 18, while the clear ball 94 (now hidden within the tube 40) would be at the lowermost point of inflection of the lower loop 20, as shown in FIG. 15.

If the movement would be continued after the position shown in FIG. 15, they would again advance back to the position shown in FIG. 13. The clear ball 94 would first move onto the edge shown at 98, and subsequently move around the back, over the top loop 18 and finally into the position of FIG. 13. Similarly, the stippled ball 96 would first move downwardly around the front edge shown at 100 around the back, through the bottom loop 20, and finally to the position shown at FIG. 13.

It is pointed out in connection with the FIGS. 12–15 that the translatory motion there shown results when every point of the form is moved relative to a fixed point externally of the form. It is for this reason that the strip is permitted to advance while the overall form appears to be stationary, with the exception of the referenced marking balls 94 and 96.

Of course, if additional sections were added to lengthen the geometrical form, such as shown in FIGS. 7 and 8, the marking balls would move through additional spirals before reaching the upper and lower end sections and then reverse their movement. However, continuous translatory movement would still be maintained despite the length of the form.

Uses of the geometrical form shown are numerous. In addition to ornamental, artistic and amusement devices or objects, the present invention exhibits properties which are useful in mechanical arrangements. The translatory arrangement described in connection with FIGS. 12–15 may be utilized in a camming action. Such translatory motion can change rectilinear motion to oscilatory motion, and vice versa.

While reference has been made throughout to annular strips, it is pointed out that this phrase is not intended to be limited to circular strips. The term annular strips in the context of the present description and claims is intended to include any flat sheet of arbitrary, peripheral edge contours or outlines. This may include square, triangular, or any shaped objects formed in sheets. Each sheet, irrespective of its outside contour or edge configuration is provided with an internal opening, which may again assume an arbitrary shape. The internal opening may be disposed anywhere within the external edge boundaries, not necessarily centrally located. The disc or section slits above described extend between an internal and external edge boundary. Similarly, the tube shown has been in the form of a cylinder, however, other shaped tubes can be utilized which would conform to the shape of the annular strips being used to form the geometric shape.

The material of the geometrical form is preferably of semi-rigid material such as a sheet of metal or elastomeric plastic or the like. Preferably, the helixes all have the same radius and the width of the strip material is substantially the same throughout.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A mobile geometrical form comprising first and second axially extending helixes interdigitally wound into each other, each end of one of said helixes continuing into a respective twisted loop which in turn continues into an adjacent end of the other of said helixes to thereby form a unitary structure, a tube axially extending through said helixes, and anchoring means on said tube for retaining said loops in axially spaced apart relationship while permitting translatory movement therethrough.

2. A mobile geometrical form as in claim 1, wherein said geometrical form is comprised of a double sided continuous strip of material, a first side of each of said helixes facing in a common axial direction and a second side of each of said helixes facing in the opposite axial direction, and wherein the first side of one of said helixes continues to the second side of the other said helix.

3. A mobile geometrical form as in claim 2, wherein both of said helixes are of substantially the same radius.

4. A mobile geometrical form as in claim 2, wherein said helixes are out of phase with each other.

5. A mobile geometrical form as in claim 2, wherein each of said twisted loops extends axially and has a point of inflection at the top thereof.

6. A mobile geometrical form as in claim 2, wherein said strip of material is made of a semi-rigid flexible material, said strip assuming the geometrical form in an infinite number of relative positions of said strip, the stresses established in said strip redistributing themselves in each relative position of said strip to maintain the shape of the geometrical form.

7. A mobile geometrical form as in claim 6, wherein said material is a sheet of metal.

8. A mobile geometrical form as in claim 6, wherein said material is a sheet of elastomeric plastic.

9. A mobile geometrical form as in claim 1 and comprised of a series of interconnected annular discs each having first and second opposing surfaces, the discs being interconnected so that the first surfaces form a continuous connection and the second surfaces form a continuous connection.

10. A mobile geometrical form comprising first and second axially extending helixes interdigitally wound into each other, each end of one of said helixes continuing into a respective twisted loop which in turn continues into an adjacent end of the other of said helixes to thereby form a unitary structure, said continuous strip of material having both an external edge and an internal edge, said internal edge forming an opening centrally of said form, a tube axially extending through said opening, and anchoring means on said tube for retaining said loops in axially spaced apart relationship while permitting translatory movement therethrough.

11. A mobile geometrical form as in claim 10, wherein said internal edge is smooth.

12. A mobile geometrical form as in claim 10, wherein said strip of material is of uniform width.

13. A mobile geometrical form as in claim 12, wherein said external edge has a predetermined length, and wherein two extensions are placed at points along said predetermined length to form therebetween two equal length portions.

14. A mobile geometrical form as in claim 10, wherein said anchoring means comprises passageway means axially extending through a diametric plane of said tube.

15. A mobile geometrical form as in claim 14, wherein said passageway means comprises a transverse channel extending from one edge of said tube.

16. A mobile geometrical form as in claim 14, wherein said passageway means comprises a transverse bore through said tube.

17. A mobile geometrical form comprising a first helical portion and a second helical portion, both said portions being concentric about a common axis and having the same direction of rotation, and being out of phase with each other, adjacent ends of said helical portions being coupled together by means of a twisted loop at each of said adjacent ends, a tube axially extending through said helical portions, and anchoring means on said tube for retaining said loops in axially spaced apart relationship while permitting translatory movement therethrough.

18. A mobile geometrical form as in claim 17, wherein both of said helical portions are of substantially the same radius.

19. A mobile geometrical form as in claim 17 and wherein said geometrical form is comprised of a double sided continuous strip of material, a first side of each of said helical portions facing in a common axial direction and a second side of each of said helical portions facing in the opposite axial direction, and wherein the first side of one of said helical portions continues to the second side of the other said helical portions.

20. A mobile geometrical form as in claim 19, wherein said strip of material is made of a semi-rigid flexible material, said strip assuming the geometrical form in an infinite number of relative positions of said strip, the stresses established in said strip redistributing themselves in each relative position of said strip to maintain the shape of the geometrical form.

* * * * *